US005677600A

United States Patent [19]

Takahashi et al.

[11] Patent Number: 5,677,600

[45] Date of Patent: Oct. 14, 1997

[54] METHOD OF MEMORY-DRIVING A PLASMA DISPLAY PANEL WITH WRITE AND SUSTAIN VOLTAGES SET UP INDEPENDENTLY OF EACH OTHER

[75] Inventors: Atsushi Takahashi; Yuji Terouchi; Yoshihiko Kobayashi, all of Tokyo, Japan

[73] Assignee: Oki Electric Industry Co., Ltd., Tokyo, Japan

[21] Appl. No.: 548,668

[22] Filed: Oct. 26, 1995

[30] Foreign Application Priority Data

Oct. 26, 1994 [JP] Japan ..... 6-262459

[51] Int. Cl.[6] ..... G09G 3/10

[52] U.S. Cl. ..... 315/169.4; 315/169.2; 315/169.1; 313/582; 313/584

[58] Field of Search ..... 315/169.4, 169.2, 315/169.1, 169.3, 167; 313/584, 582, 586, 587, 590

[56] References Cited

U.S. PATENT DOCUMENTS

| | | | |
|---|---|---|---|
| 4,097,856 | 6/1978 | Lamoureux et al. | 315/169 TV X |
| 4,692,665 | 9/1987 | Sakuma | 315/169.4 |
| 5,315,213 | 5/1994 | Kim | 315/169.1 |
| 5,446,344 | 8/1995 | Kanazawa | 315/169.4 |

FOREIGN PATENT DOCUMENTS

| | | |
|---|---|---|
| 0 160 455 | 11/1985 | European Pat. Off. . |
| 0 575 730 | 12/1993 | European Pat. Off. . |
| 5-119740 | 5/1993 | Japan . |

OTHER PUBLICATIONS

Takano, Yoshimichi "Cathode Pulse Memory Drive of 40-in. DC-PDP", Technical Report of IEICE. EID93-118 (1994-01), The Institute of Electronics, Information and Communication Engineers of Japan.

Takano, Y. et al., "33.5: Late-News Paper: A 40-in. DC-PDP with New Pulse-Memory Drive Schem" SID '94 Digest, pp. 731-734, (1994).

*Primary Examiner*—Robert Pascal
*Assistant Examiner*—Haissa Philogene
*Attorney, Agent, or Firm*—Spencer & Frank

[57] ABSTRACT

In a memory drive scheme of a plasma display panel, scan pulses are sequentially applied to scan electrodes and a train of sustain pulses is applied subsequent to the scan pulses to each of the scan electrodes during a certain period of time. A non-write pulse, which offers a turn-off level only when display information directed to the display cells is of a non-display is applied to the display electrodes in synchronism with the scan pulses. A write discharge is initiated for the display cells when the display cells are brought into a display state by applying the scan pulses to the scan electrodes and maintaining the scan electrodes in a turn-on level. The display is sustained in response to the sustain pulse train applied to the scan electrode following the scan pulse and dependent on the turn-on level of the display electrode.

4 Claims, 10 Drawing Sheets

Fig. 1 PRIOR ART
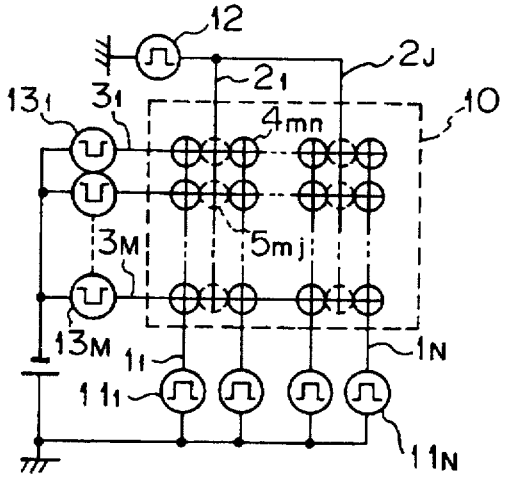
PRIOR ART
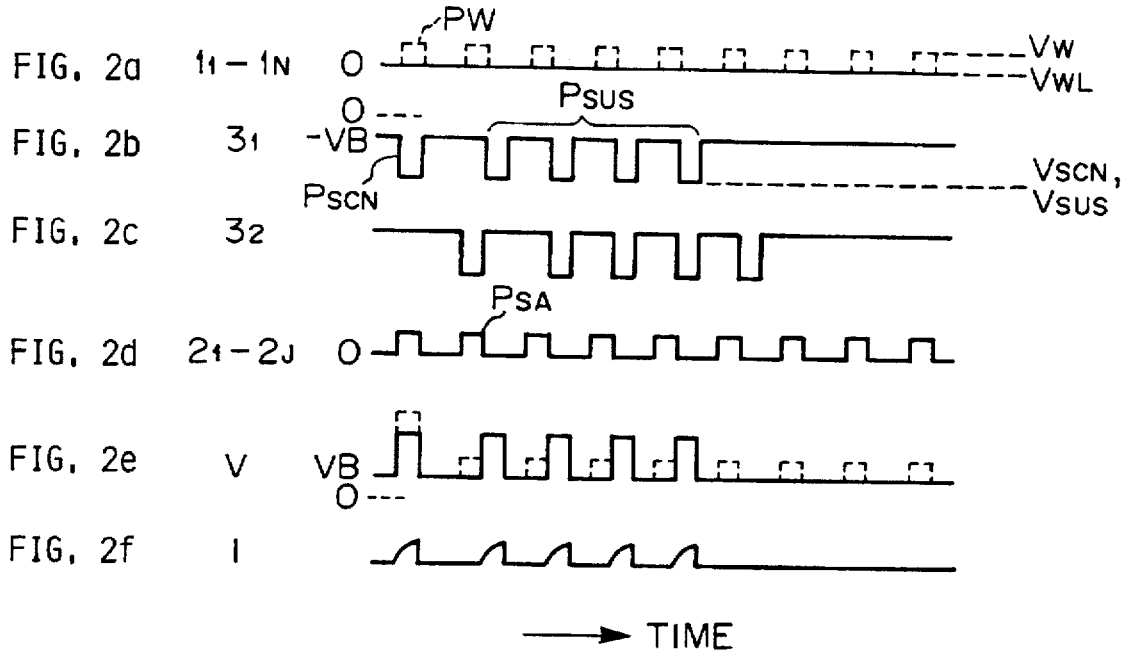

Fig. 3 PRIOR ART
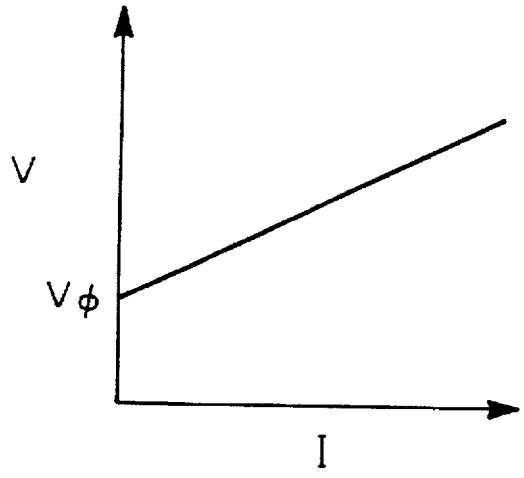
I-V CHARACTERICTICS
PRIOR ART
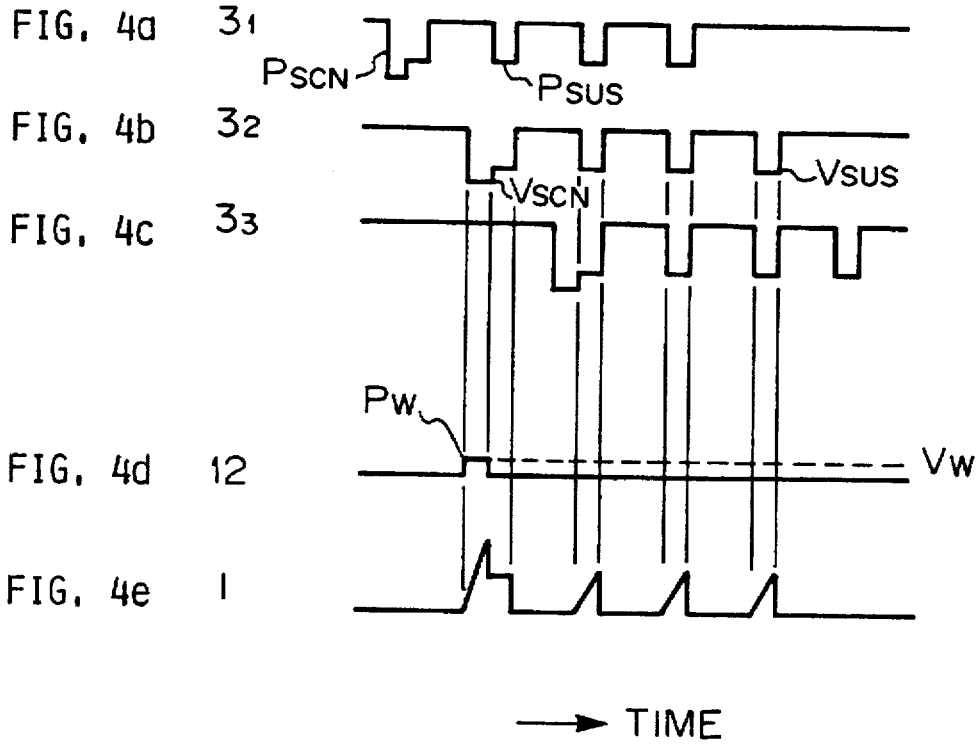

PRIOR ART
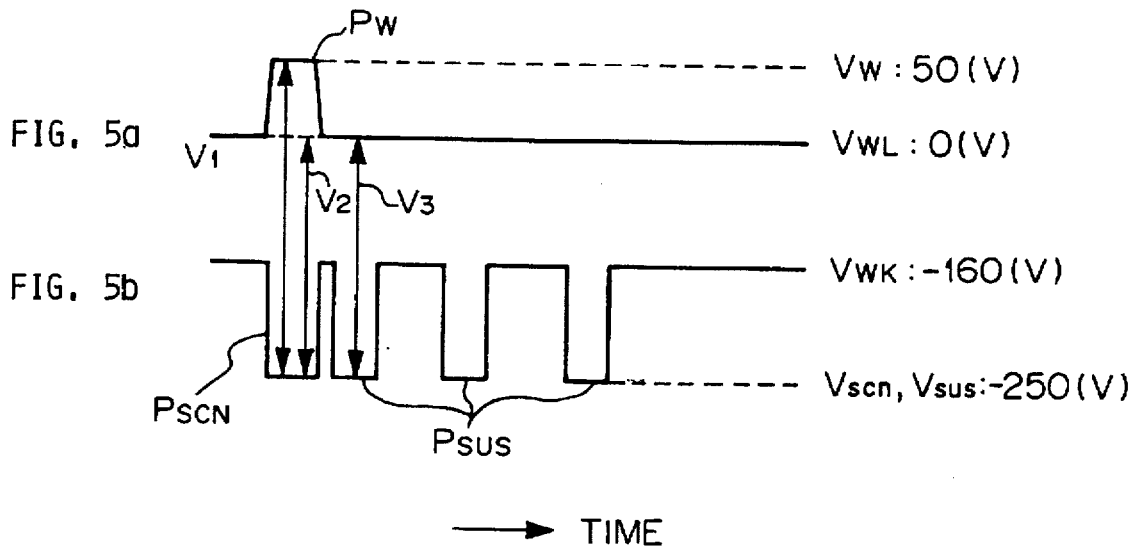

PRIOR ART

VSA : 300 (V)
VBS : 280 (V)
VBA : 305 (V)
VNW : 220 (V)
VBK : 85 (V)
VSUS : 50 (V)
VSCN : 0 (V)
τSA
PSA
τNW
PNW
τSCN
PSCN
4μS
τSUS
PSUS
4μS
S
A1
A2
AN
K1
K2
KM

TIME

METHOD OF MEMORY-DRIVING A PLASMA DISPLAY PANEL WITH WRITE AND SUSTAIN VOLTAGES SET UP INDEPENDENTLY OF EACH OTHER

BACKGROUND OF THE INVENTION

1. Field of the Invention

The present invention relates to a memory drive for use in a direct-current plasma display panel (DC-PDP) which is expected to implement a thin and extended display screen suitable for displaying high-definition television (Hi-Vision) pictures, for example.

2. Description of the Background Art

Hitherto, in the field of art, there are published Yoshimichi Takano, "Cathode Pulse Memory Drive of 40-in. DC-PDP", Technical Report of IEICE. EID93-118 (1994-01), The Institute of Electronics, Information and Communication Engineers of Japan, and Japanese patent laid-open publication No. 119740/1993. Also, published is Y. Takano, et al., "33.5: Late-News Paper: A 40-in. DC-PDP with New Pulse-Memory Drive Schem" SID '94 Digest, pp. 731–734, (1994).

FIG. 1 is a schematic circuit diagram of the conventional DC-PDP and its peripheral circuit. In FIG. 1, the DC-PDP 10 comprises a plurality of display discharge anodes or display electrodes $\mathbf{1}_1$–$\mathbf{1}_N$, where N is a positive integer, auxiliary anodes or electrodes $\mathbf{2}_1$–$\mathbf{2}_J$ and cathodes or scan electrodes $\mathbf{3}_1$–$\mathbf{3}_M$, where M is a positive integer. At the intersections of the display anodes $\mathbf{1}_1$–$\mathbf{1}_N$ and the cathodes $\mathbf{3}_1$–$\mathbf{3}_M$ there are provided display cells *4mn* ($1 \leqq n \leqq N$, $1 \leqq m \leqq M$), each adapted to perform a display by discharge. In addition, at the intersections of the auxiliary anodes $\mathbf{2}_1$–$\mathbf{2}_J$ and the cathodes $\mathbf{3}_1$–$\mathbf{3}_M$ there are provided auxiliary cells 5 mj ($1 \leqq j \leqq L$).

Coupled to the display discharge anodes $\mathbf{1}_1$–$\mathbf{1}_N$ are anode drive circuits $\mathbf{11}_1$–$\mathbf{11}_N$, respectively. Also coupled to the auxiliary anodes $\mathbf{2}_1$–$\mathbf{2}_J$ is a single auxiliary anode drive circuit 12. Further, coupled to the cathodes $\mathbf{3}_1$–$\mathbf{3}_M$ are cathode drive circuits $\mathbf{13}_1$–$\mathbf{13}_M$, respectively.

FIGS. *2a–2f* show waveforms useful for understanding the memory drive for use in the conventional DC-PDP described in the above-referenced Yoshimichi Takano article. Referring to FIG. *2a*, write pulses Pw as information to be displayed are applied from the anode drive circuits $\mathbf{11}_1$–$\mathbf{11}_N$ to the display discharge anodes $\mathbf{1}_1$–$\mathbf{1}_N$, respectively. A data signal takes its high level only when a writing is conducted to a desired display cell *4mn*. This is the write pulse Pw. On the other hand, scan pulses PSCN (FIGS. *2b* and *2c*) and the subsequent sustain pulses $P_{SUS}$ (FIGS. *2b* and *2c*) are sequentially applied from the cathode drive circuits $\mathbf{131}$–$\mathbf{13}_M$ to the cathodes $\mathbf{3}_1$–$\mathbf{3}_M$, respectively. Auxiliary discharge pulses $P_{SA}$ (FIG. *2d*) are applied from the auxiliary anode drive circuit 12 to the auxiliary anodes $\mathbf{21}$–$\mathbf{2}_J$ at the same timing. Thus, the display discharge anodes $\mathbf{1}_1$–$\mathbf{1}_N$ form a display electrode group, while the cathodes $\mathbf{3}_1$–$\mathbf{3}_M$ form a scan electrode group.

FIG. 3 plots the relation between the current and voltage in the display cell shown in FIG. 1, with its abscissa denoting a discharge current I and ordinate denoting a voltage V between the anode and the cathode. An incremental charge in the voltage V between the display discharge anodes $\mathbf{1}_N$ and the cathode $\mathbf{3}_M$ in the display cell *4mn* produces an incremental charge of the discharge current I at approximately the same rate as the incremental change of the voltage, as plotted in FIG. 3. Such a characteristic of current I and voltage V is referred to as an I–V characteristic. In the figure, Vϕ denotes the V-segment of the I–V characteristic, which is the value intersecting the vertical axis of the graph and below which no discharge occurs in the cells. In an application where a mixed gas of helium and xenon, as the discharge gas, is enclosed in the DC-PDP cells, for example, the voltage Vϕ is about 220 volts in the I–V characteristic of the display cell *4mn*, while the voltage Vϕ is about 230 volts in the auxiliary discharge cell *5mj*.

According to the Yoshimichi Takano article mentioned above, the voltage between the high level of potential Vw of a write pulse Pw and the low level of potential $V_{SCN}$ of a scan pulse $P_{SCN}$ is 305 volts which causes the display cell *4mn* to initiate a write discharge. The voltage 255 volts between the low level of potential $V_{SUS}$ of a sustain pulse $P_{SUS}$, which is applied during a certain period of time subsequent to the write pulse Pw, and the low level of potential $V_{WL}$ of the data signal serves to intermittently continue the sustain discharge so as to provide a memory function. In the auxiliary discharge cell *5mj*, the voltage between the high level of potential $V_{SA}$ of an auxiliary discharge pulse $P_{SA}$ and the low level of potential $V_{SCN}$ of a scan pulse $P_{SCN}$ is 300 volts to conduct the auxiliary discharge which causes the display cell *4mn* to smoothly initiate the display discharge. If the potential $V_{SCN}$ and the potential $V_{SUS}$ are given the same value, the circuit will be simplified in structure.

FIGS. *4a–4e* show waveforms useful for understanding another memory drive scheme of the conventional DC-PDP described in the above-referenced Japanese patent laid-open publication No. 119740/1993. Also according to the publication, the voltage between the high level of potential of a write pulse Pw (FIG. *4d*) and the low level of potential of a scan pulse $P_{SCN}$ (FIG. *4a*) causes the display cell *4mn* to initiate the write discharge. The voltage between the low level of potential of a sustain pulse $P_{SUS}$ (FIG. *4a*), which is applied during a certain period of time subsequent to the write pulse Pw, and the low level of potential of the data signal serves to intermittently continue the sustain discharge. Thus, according to laid-open publication No. 119740/1993, it is possible to implement the anode drive circuits $\mathbf{11}_1$–$\mathbf{11}_N$ with a simplified structure. While FIGS. *4a–4e* show that the potential $V_{SCN}$ and the potential $V_{SUS}$ are different, laid-open publication No. 119740/1993 says that if the potential $V_{SCN}$ and the potential $V_{SUS}$ are given by the same value, the cathode drive circuits $\mathbf{13}_1$–$\mathbf{13}_M$ will be simplified in structure.

However, the memory drive scheme of the conventional DC-PDP involves the following drawbacks. FIGS. *5a* and *5b* show waveforms useful for understanding the potentials shown in FIGS. *2a–2f*. As described in the Yoshimichi Takano article, with the memory drive scheme of the DC-PDP in which the potential $V_{SCN}$ and the potential $V_{SUS}$ are equal to each other, the voltage appearing between the display discharge anode and the cathode in the display cell *4mn* during non-writing becomes equal to the voltage appearing during the sustain discharge. This fails to provide a degree of freedom in setting up the width and amplitude of the write pulse Pw. Thus, it is difficult to conduct an adjustment, in other words, it is difficult to ensure a sufficient memory margin, which means the range of the sustain discharge voltage with which a normal sustain discharge can be obtained.

For example, in an application in which the high level of potential Vw of the write pulse Pw is 50 volts, the low level of potential $V_{WL}$ of the data signal is zero volts, the bias potential Vb of the cathodes $\mathbf{3}_1$–$\mathbf{3}_M$ is −160V, the low level of potential $V_{SCN}$ of the scan pulse $P_{SCN}$ is −255V, and the low level of potential $V_{SUS}$ of the sustain pulse $P_{SUS}$ is −255V, voltage V1 between the display discharge anodes $1_N$ and the cathode $3_M$ in the display cell 4mn is 305V during the writing. Voltage V2 during the non-writing is 255V, and voltage V3 during the sustain discharge by the sustain pulse $P_{SUS}$ is also 255V. When the voltage V2 is 255V, since the voltage V2, 255V, exceeds the value 220V which is the voltage of the V-segment Vϕ of the I–V characteristic of the display cell mentioned earlier, there is a possibility that a discharge occurs in the display cell 4mn, even during the non-writing. On the other hand, for the purpose of preventing an erroneous discharge from taking place during non-writing, if the potential $V_{SCN}$ of the scan pulse $P_{SCN}$ has values which are too high (i.e. V2 is decreased), this renders the potential $V_{SUS}$ higher for setting up the sustain discharge (i.e. V3 is decreased). This causes the discharge cell to fail to form the sustain discharge. Conversely, for the purpose of surely obtaining the sustain discharge, if the potential $V_{SUS}$ of the sustain pulse $P_{SUS}$ is decreased so that the voltage V3 has values which are too high, this causes the voltage V2 to be increased during the non-writing, thereby inducing an erroneous discharge. Thus, according to the memory drive scheme of the conventional DC-PDP, it is difficult to ensure a sufficient memory margin.

FIGS. 6a and 6b waveforms are useful for understanding how the potential shown in FIGS. 4a–4e are setup. Now consider the potential set-up, for example, as shown in FIGS. 4a–4e in which the potential $V_{SCN}$ of the scan pulse $P_{SCN}$ and the potential $V_{SUS}$ of the sustain pulse $P_{SUS}$ are different from each other in potential level. Assuming that the low level of potential $V_{SCN}$ of the scan pulse $P_{SCN}$ on the cathode $3_M$ is given with zero volts, the voltage V1 during the writing which is to be applied to the display discharge anode $1_N$, is set up to 305V, and the voltage V2 during the non-writing is set up to the maximum voltage 220V which involves no formation of the discharge during the non-writing. That is, the high level of potential Vw of the write pulse Pw is 305V, the low level of potential Vwn of the data signal is 220V. On the other hand, since voltage V3 during the sustain discharge is 255V, the low level of potential $V_{SUS}$ of the sustain pulse $P_{SUS}$ is −35V, which is equal to 220V−255V. The bias potential $V_{BK}$ of the cathode is selected in such a manner that the voltage V6 applied to the display cell is 220V, which is the maximum voltage involving no formation of the discharge, so as not to establish the discharge in combination of the bias potential $V_{BK}$ of the cathode with the potential of the write pulse Pw. Namely, the bias potential $V_{BK}$ is 85V, which is equal to 305V−220V. In order that voltage V4 for the auxiliary discharge is 300V, a potential of 300V is applied to the auxiliary cathode in timed with the scan pulse $P_{SCN}$. In order to prevent the auxiliary discharge cell 5mj from erroneously discharging during a period of time other than the scan pulse $P_{SCN}$, the voltage V5 applied to the auxiliary discharge cell 5mj is set up to 230V, which is the maximum voltage involving no formation of a discharge. That means the low level of potential $V_{SAL}$ of the auxiliary pulse $P_{SA}$ is given by 195V, which is equal to −35V+230V.

The set-up of the voltages as described above makes it possible to set up the voltages V1 and V2 for writing separately from the voltage V3 for sustaining. Thus, the memory margin characteristics of the respective display cells 4mn are not harmed. However, the set-up of the voltages in the manner as described above needs having high amplitudes pulses such that the amplitude on the cathode $3_M$ is 120V, the amplitude on the display discharge anode $1_N$ is 85V, and the amplitude on the auxiliary cathode 2j is 105V. This makes it difficult to incorporate the peripheral circuits of the display device into an integrated circuit.

SUMMARY OF THE INVENTION

It is therefore an object of the present invention to provide a memory drive of a direct-current plasma display panel in which a sufficient memory margin is ensured without increasing the amplitudes of the pulses to be applied to the electrodes of the cells of the display panel.

In order to solve the problems set forth above, according to the invention, a method of memory driving a plasma display panel, which comprises a group of display electrodes constituted of a plurality of linear electrodes, a group of scan electrodes constituted of a plurality of linear electrodes arranged in such a manner that said group of scan electrodes is placed over against said group of display electrodes and is perpendicular to said group of display electrodes, and is perpendicular to said group of display electrodes, a discharge gas being enclosed between said group of display electrodes and said group of scan electrodes, and a plurality of display cells disposed on intersections of the respective display electrodes and the respective scan electrodes, each of said plurality of display cells emitting light through a discharge between an associated display electrode and an associated scan electrode, comprises the steps of: sequentially applying scan pulses to the scan electrodes and, applying a train of sustain pulses subsequent to the scan pulses to each of the scan electrodes during a certain period of time; applying a non-write pulse to the display electrodes in synchronism with the scan pulses, the non-write pulse offering a turn-off level only when display information directed to the display cells is of a non-display; and initiating a write discharge for the display cells, when the display cells are brought into a display state, by means of applying the scan pulses the scan electrodes, maintaining the display electrodes in a turn-on level, and sustaining the discharge in response to the train of sustain pulses applied to the scan electrode following the scan pulse and dependent on the turn-on level of the display electrode.

BRIEF DESCRIPTION OF THE DRAWINGS

The objects and features of the present invention will become more apparent from consideration of the following detailed description taken in conjunction with the accompanying drawings in which:

FIG. 1 is a schematic circuit diagram showing the conventional DC-PDP and its peripheral circuit;

FIGS. 2a–2f show waveforms useful for understanding a memory drive scheme of the conventional DC-PDP;

FIG. 3 plots the relation between the current and the voltage in the display cell shown in FIG. 1;

FIGS. 4a–4e show waveforms useful for understanding another memory drive scheme of the conventional DC-PDP;

FIGS. 5a and 5b show waveforms useful for understanding the potential shown in FIG. 2;

DESCRIPTION OF THE PREFERRED EMBODIMENTS

Figures 6A, 6B:
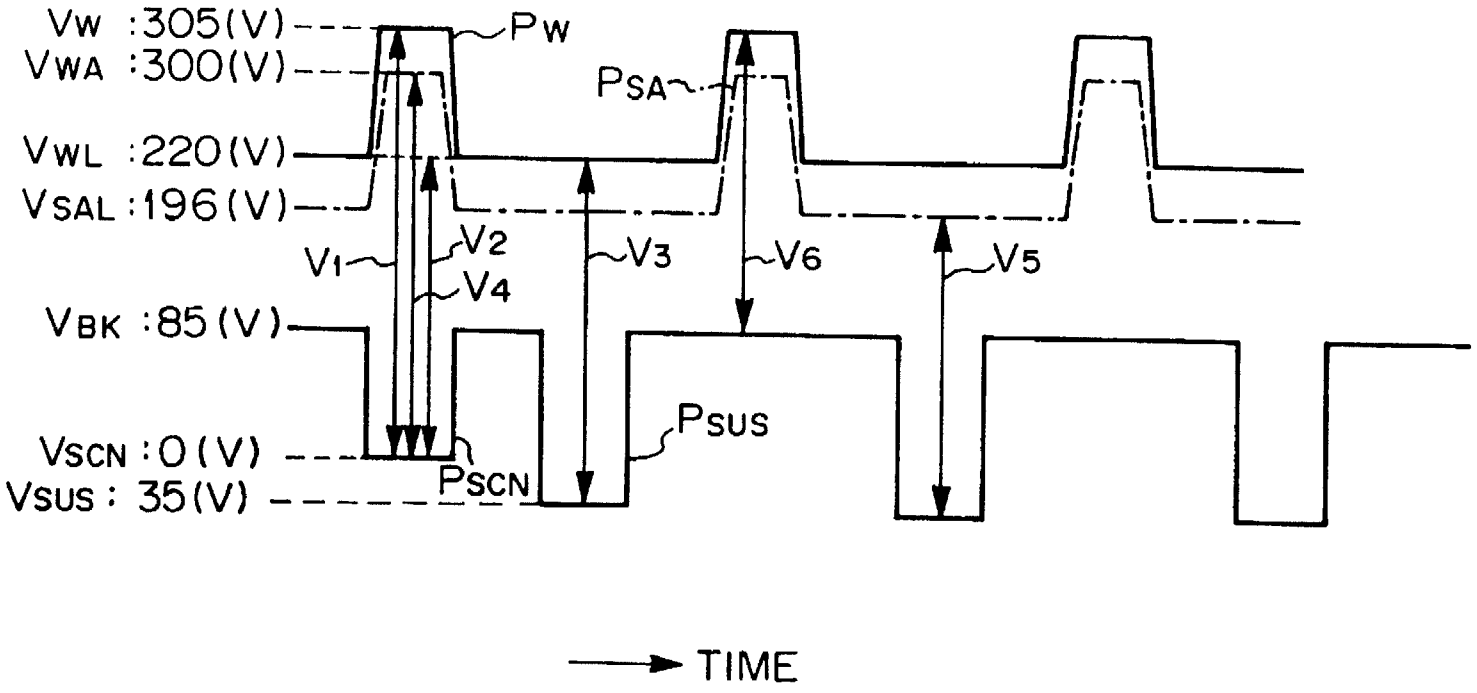
FIGS. 6a and 6b show waveforms useful for understanding the potential set-up shown in FIG. 4.
Figure 7:
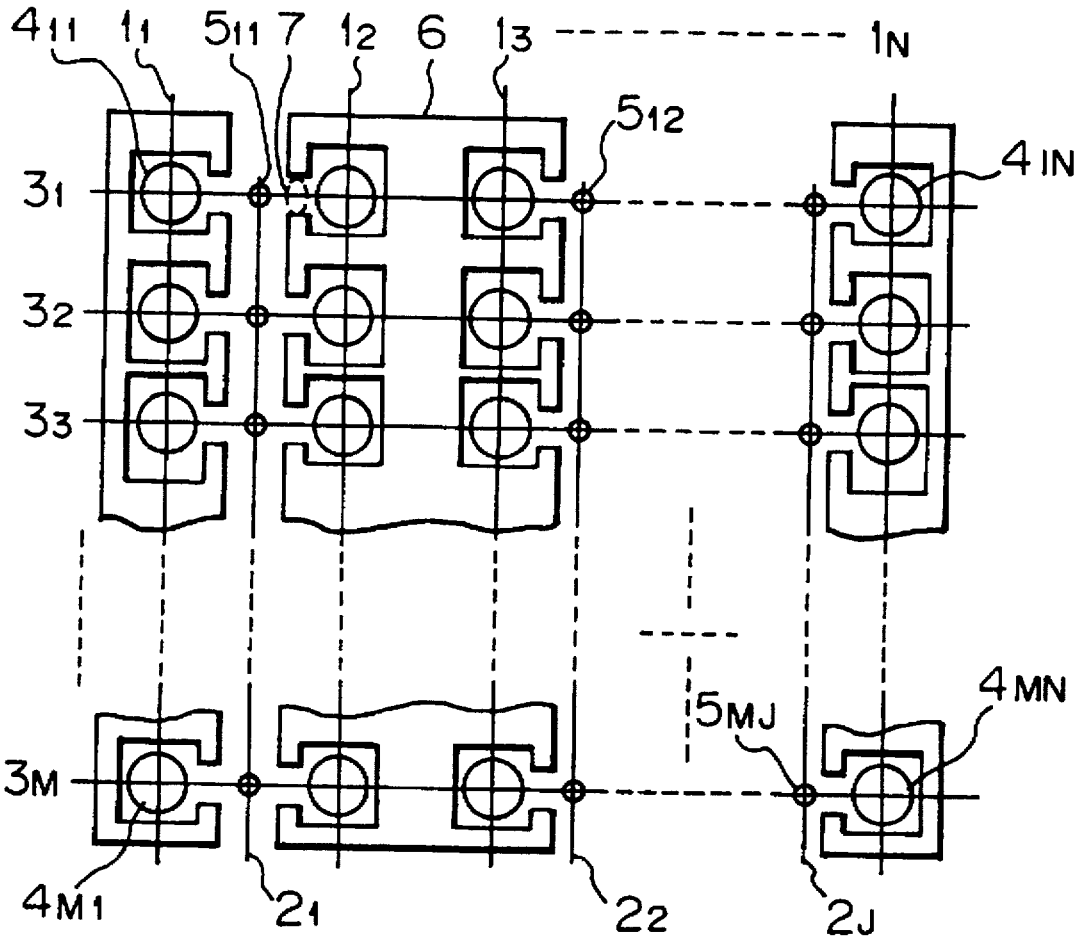
FIG. 7 is a plan view schematically showing a construction of the DC-PDP according to an embodiment of the present invention.
Figure 8:
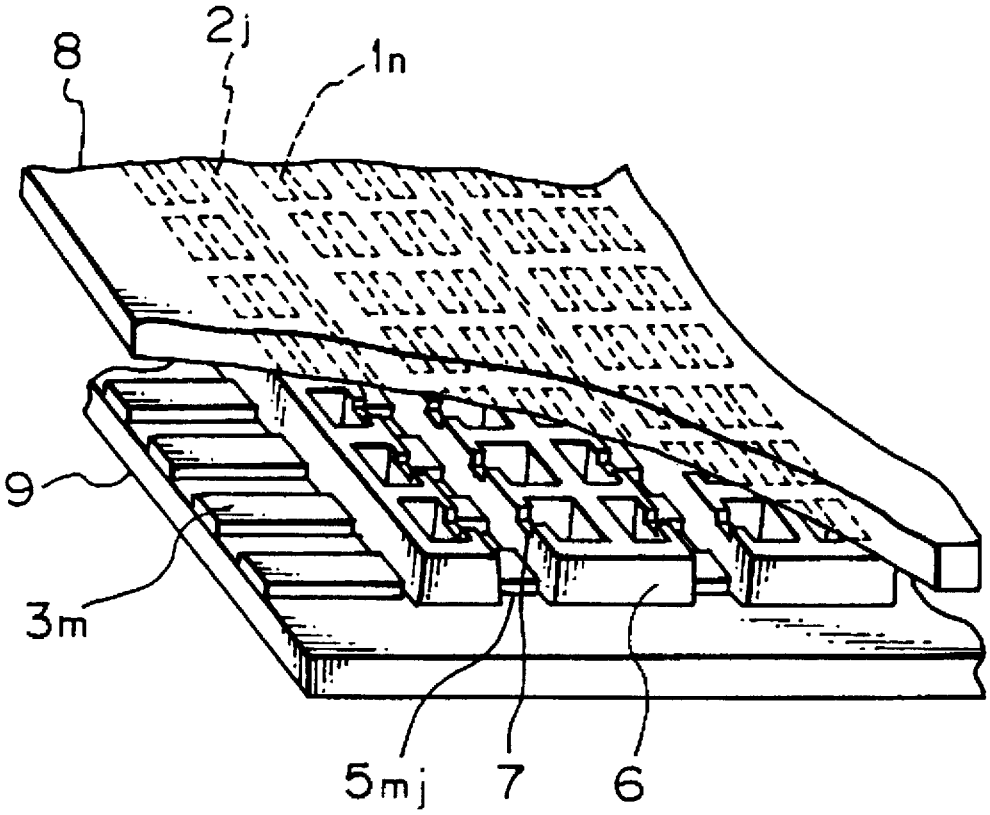
FIG. 8 is a perspective view schematically showing the construction of the DC-PDP according to the embodiment shown in FIG. 7.

FIGS. 7 and 8 schematically show a construction of a direct-current plasma display panel (DC-PDP) according to an embodiment of the present invention. In FIGS. 7 and 8, the like parts are denoted by the same reference numerals as those of FIG. 1. As shown in FIG. 7, the embodiment of a DC-PDP in accordance with the invention comprises display electrodes of display discharge anodes $\mathbf{1}_1$–$\mathbf{1}_N$ in which a plurality of linear electrodes are arranged, auxiliary electrodes or auxiliary anodes $\mathbf{2}_1$–$\mathbf{2}_J$ and scan electrodes or cathodes $\mathbf{3}_1$–$\mathbf{3}_M$ which intersect perpendicularly to the display discharge anodes $\mathbf{1}_1$–$\mathbf{1}_N$ and the auxiliary anodes $\mathbf{2}_1$–$\mathbf{2}_J$, where N, J and M are natural numbers. The respective intersections of the display discharge anodes $\mathbf{1}_1$–$\mathbf{1}_N$ and the cathodes $\mathbf{3}_1$–$\mathbf{3}_M$ form associated display cell 4*mn*, where $1 \leqq n \leqq N$, and $1 \leqq m \leqq M$. Further, the respective intersections of the auxiliary anodes $\mathbf{2}_1$–$\mathbf{2}_J$ and the cathodes $\mathbf{3}_1$–$\mathbf{3}_M$ form also associated auxiliary discharge cell 5*mj*, where $1 \leqq j \leqq J$. The respective display cells 4*mn* are spatially isolated from each other with barriers 6, and are each coupled with the adjacent auxiliary cell through a priming slit 7.

As shown in FIG. 8, the display discharge anodes $\mathbf{1}_1$–$\mathbf{1}_N$ and the auxiliary anodes $\mathbf{2}_1$–$\mathbf{2}_J$ are formed on a front plate 8, and the cathodes $\mathbf{3}_1$–$\mathbf{3}_M$ are formed on a rear plate 9 located over and against the front plate 8. A discharge gas, such as a mixture of helium and xenon, is enclosed between the front and rear plates 8 and 9. A phosphor layer, not shown, is disposed on each display cell 4*mn*. When a discharge is formed between the display discharge anode $\mathbf{1}_N$ and the cathode $\mathbf{3}_M$, ultraviolet rays are radiated to excite the phosphor layer, from which visible light emanates in turn.

The display discharge anodes $\mathbf{1}_1$–$\mathbf{1}_N$, the auxiliary anodes $\mathbf{2}_1$–$\mathbf{2}_J$ and the cathodes $\mathbf{3}_1$–$\mathbf{3}_M$ are connected in a fashion similar to that of FIG. 1, so that the display cells 4*mn* are driven on a memory basis. According to the present embodiment, the display discharge anodes $\mathbf{1}_1$–$\mathbf{1}_N$ serve as the display electrodes, to which pulses each representative of information to be displayed and directed to the associated display cell 4*mn* are applied from the anode drive circuits $\mathbf{11}_1$–$\mathbf{11}_N$ (see FIG. 1). On the other hand, the cathodes $\mathbf{3}_1$–$\mathbf{3}_M$ serve as the scan electrodes, to which scan pulses are applied from the cathode drive circuits $\mathbf{13}_1$–$\mathbf{13}_M$ (see FIG. 1).

FIGS. 9*a*–9*g* show waveforms useful for understanding a memory drive scheme of the DC-PDP according to the embodiment of the present invention. FIGS. 9*a*–9*g* show an auxiliary anode signal S which is applied in common to the respective auxiliary anodes $\mathbf{2}_1$–$\mathbf{2}_J$, display anode signals (hereinafter referred to also as data signals) $A_1, A_2, \ldots, A_N$ which are applied to the display discharge anodes $\mathbf{1}_1, \mathbf{1}_2, \ldots \mathbf{1}_N$, and cathode signals $K_1, K_2, \ldots, K_M$ which are applied to the cathodes $\mathbf{3}_1, \mathbf{3}_2, \ldots \mathbf{3}_M$. Each of the cathode signals $K_1, K_2, \ldots, K_M$ comprises a scan pulse $P_{SCN}$ and the subsequent sustain pulses $P_{SUS}$ which appear during a certain period of time and are each different from the scan pulse $P_{SCN}$ in phase. The cathode signals $K_1, K_2, \ldots, K_M$ are sequentially applied to the cathodes $\mathbf{3}_1, \mathbf{3}_2, \ldots \mathbf{3}_M$, respectively. The display anode signals (data signals) $A_1, A_2, \ldots, A_N$ are each a binary signal and are applied to the display discharge anodes $\mathbf{1}_1, \mathbf{1}_2, \ldots \mathbf{1}_N$, respectively. The low or OFF, level of the data signal, called the non-write pulse $P_{NW}$, is applied in synchronism with the scan pulse $P_{SCN}$ only when a write discharge on the display cell 4*mn* is not conducted. The high, or ON, level of the data signal is applied during the remaining period of time. The auxiliary anode signal S serves to apply an auxiliary discharge pulse $P_{SA}$ to the auxiliary anodes $\mathbf{2}_1$–$\mathbf{2}_J$ in synchronism with the scan pulse $P_{SCN}$.

Figures 9A, 9B, 9C, 9D, 9E, 9F, 9G:
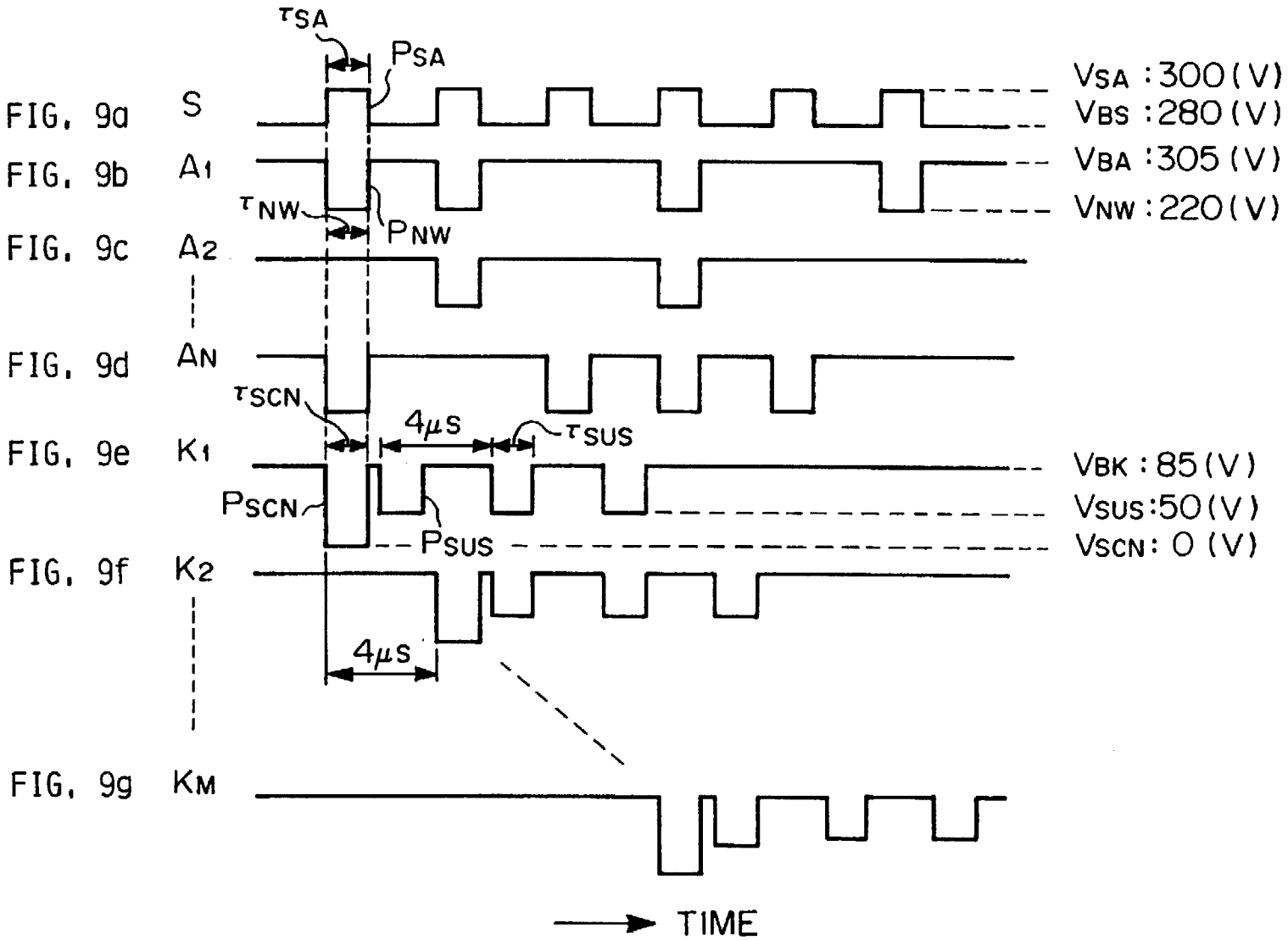
FIGS. 9a–9g show waveforms useful for understanding a memory drive scheme of the DC-PDP according to the embodiment shown in FIG. 7.
Figures 10A, 10B:
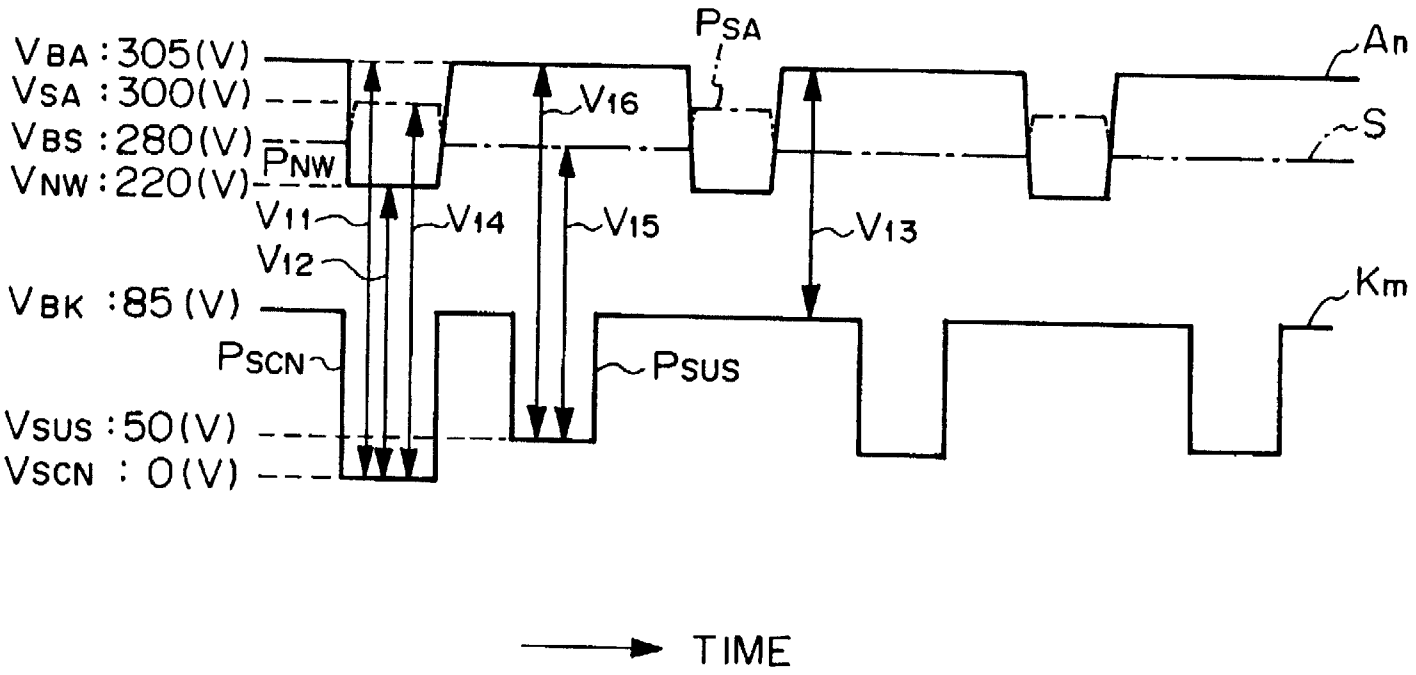
FIGS. 10*a* and 10*b* show waveforms useful for understanding how the potential shown in FIG. 1 is set up.

FIGS. 10*a* and 10*b* show waveforms useful for understanding the potential set-up shown in FIGs. 9*a*–$\mathbf{9}_g$. For example, in an application where the low level of potential $V_{SCN}$ of the scan pulse $P_{SCN}$ on the cathode $\mathbf{3}_M$ is zero volts, the bias potential $V_{BA}$ of the display discharge anode $\mathbf{1}_N$ is set up to 305V so that the write voltage V11 to be applied to the display cell 4*mn* becomes 305V. The low level of potential $V_{NW}$ of the non-write pulse $P_{NW}$ is also set up to 220V so that the voltage V12 during non-writing is 220V which is the maximum voltage involving no discharge. On the other hand, since the sustain voltage on the display cell 4*mn* is to be 255V corresponding to V16, the low level of potential $V_{SUS}$ of the sustain pulse $P_{SUS}$ is set up to 50V, which is equal to 305V–255V.

The bias potential $V_{BK}$ of the cathode $\mathbf{3}_M$ is set up to 85V, equal to 305V–220V, so that voltage V13 between the bias potential $V_{BK}$ of the cathode $\mathbf{3}_M$ and the bias potential $V_{BA}$ of the display discharge anode $\mathbf{1}_N$ is 220V, for example, which is the maximum voltage involving no discharge. Since the auxiliary discharge voltage V14 is 300V, the high level of potential $V_{SA}$ of the auxiliary pulse $P_{SA}$ is set up to be 300V in timed with the scan pulse $P_{SCN}$. In order to prevent the auxiliary cell 5*mj* from inducing the discharge during a period in which the scan pulse $P_{SCN}$ is not supplied, the bias potential $V_{BS}$ of the auxiliary node signal S is set up to 280V, equal to 230V+50V, so that the voltage V15 applied to the auxiliary cell 5*mj* is 230V which is the maximum voltage involving no discharge.

Next, the operation of the DC-PDP in which the waveforms shown in FIGS. 9*a*–9*g* are applied will be described. For example, the scan pulses $P_{SCN}$ having the pulse width $\tau_{SCN}$ of 1.5 μs are supplied every 4 μs to the cathodes $\mathbf{3}_1, \mathbf{3}_2, \ldots \mathbf{3}_M$ functioning as the scan electrodes. The supply of the scan pulses $P_{SCN}$ to the cathodes $\mathbf{3}_1, \mathbf{3}_2, \ldots \mathbf{3}_M$ is sequentially conducted with time lag. The auxiliary discharge pulses $P_{SA}$ having the pulse width $\tau_{SA}$ of 1.5 μs, which are synchronized with the scan pulses $P_{SCN}$, are applied to the auxiliary anodes $\mathbf{2}_1$–$\mathbf{2}_J$ every 4 μs, so that the auxiliary discharge in the auxiliary discharge cell 5*mj* is shifted together with the scan pulse $P_{SCN}$. Following the scan pulse $P_{SCN}$, the sustain pulses $P_{SUS}$ having the pulse width $\tau_{SUS}$ of 1.5 μs are applied to each of the cathodes $\mathbf{3}_1, \mathbf{3}_2, \ldots \mathbf{3}_M$ during a certain period of time at a timing not overlapping the scan pulse $P_{SCN}$. Since the potential $V_{SA}$ of the auxiliary anodes $\mathbf{2}_1$–$\mathbf{2}_J$ is 280V during a period of time in which the sustain pulse $P_{SUS}$ is applied, the voltage applied to the auxiliary discharge cell 5*mj* is 230V, corresponding to $V_{BS}$–$V_{SUS}$. Thus, it does not happen that the auxiliary discharge cell 5*mj* involves a discharge in this timing. The bias voltage $V_{BK}$ of the cathodes $\mathbf{3}_1, \mathbf{3}_2, \ldots \mathbf{3}_M$ is 85V during a period of time in which none of the scan pulse $P_{SCN}$ and the sustain pulse $P_{SUS}$ is applied thereto. If the information to be displayed is not representative of the non-display, then the potential of the n-th column of display discharge anode $\mathbf{1}_N$ is the bias voltage $V_{BA}$, which is 305V in this instance.

When the potential of the m-th row of cathode $\mathbf{3}_M$ is the low level of potential $V_{SCN}$, i.e. OV, through application of the scan pulse $P_{SCN}$, the voltage is 305V between the display discharge anode $1_N$ and the cathode $3_M$, so that the write discharge is initiated on the display cell 4mn. At that time, the ions, excited atoms and the like are diffused from the m-th row of the auxiliary discharge cell 5mj, which discharges near the display cell 4mn, through the priming slit 7 as shown in FIG. 7 to the display cell 4mn. In the display cell 4mn, the write discharge is immediately formed with help of the ions, the excited atoms and the like. On the other hand, in a case where a write discharge is not conducted on the display cell 4mn, which means non-writing, a non-write pulse $P_{NW}$ having the pulse width $\tau_{NW}$ of 1.5 μs is applied to the n-th column of display discharge anode $1_N$ in synchronism with the scan pulse $P_{SCN}$ applied to the cathode $3_M$. At that time, the voltage applied to the display cell 4mn is 220V, corresponding to $V_{NW}-V_{SCN}$, and does not reach the voltage which forms the discharge. Thus, the write discharge to the display cell 4mn is not accomplished.

A gaseous discharge is provided with such characteristics that ions and excited atoms, which emanate by the discharging, are gradually decreased after the discharging are terminated, and the presence of the ions and excited atoms is prone to involve a redischarge. Consequently, for example, it a write discharge is formed on the display cell 4mn, then the discharge can be maintained on the display cell 4mn, in spite of the voltage 255V lower than the write voltage 305V, in timing with the sustain pulse $P_{SUS}$ which is supplied following the scan pulse $P_{SCN}$. The display cell 4mn sustains an intermittent discharge by the sustain pulse $P_{SUS}$. Thus, the memory drive is implemented. Ultraviolet rays emanating through the discharge are absorbed by the phosphor layers, so that the phosphor layers emit visual light. When the application of the sustain pulse $P_{SUS}$ to the cathode $3_M$ is stopped, the sustain discharge on the display cell 4mn is stopped. In the display cell in which the write discharge is not formed, there are a few ions and excited atoms. Thus, the sustain pulse $P_{SUS}$ applied following the scan pulse $P_{SCN}$ does not serve to form the discharge.

As described above, according to the embodiment, when the display discharge is formed on the display cell 4mn, the potential of the display discharge anode $1_N$ is set to the bias potential $V_{BA}$ corresponding to the high level of the data signal, the low level of potential $V_{SCN}$ of the scan pulse $P_{SCN}$ is applied to the cathode $3_M$ to form the write discharge, and the sustain discharge is conducted in the form of pulses with a voltage between the low level of potential $V_{SUS}$ in the subsequent sustain pulse $P_{SUS}$ and the bias potential $V_{BA}$. On the other hand, in the case of non-writing, the low level of potential $V_{NW}$, equivalent to the OFF level of the non-write pulse $P_{NW}$, is applied to the display discharge anode $1_N$ in synchronism with the scan pulse $P_{SCN}$ applied to the cathode $3_M$. Hence, it is possible to set up the voltage V11 for writing separately from the voltage V13 for sustain discharging.

For example, decrement of the potential $V_{NW}$ of the OFF level of the non-write pulse $P_{NW}$ makes it possible to set up the voltage V12 for non-writing to a value which is sufficiently lower than the voltage Vϕ of the V-segment of the I–V characteristic shown in FIG. 3 concerning the display cell 4mn. Also in this case, the voltage V16 for conducting the sustain discharge, as shown in FIGS. 10 and 10b, is not varied. In other words, it is possible to establish a sufficient memory margin for the respective display cells.

The display anode signals applied to the display discharge anodes $1_1$–$1_N$ are each a binary signal. The use of the binary signals make it possible to simplify the drive circuits in structure. Further, according to the present embodiment, the amplitudes of the auxiliary anode signal S, the display anode signals $A_1, A_2, \ldots, A_N$ and the cathode signals $K_1, K_2, \ldots, K_M$ are reduced, as 20V, 85V and 85V, respectively, as shown in FIGS. 10a and 10b, in comparison with the prior art scheme. This permits the drive circuits to be miniaturized and facilitates the drive circuits to be fabricated into an integrated circuit. Further, reducing the amplitude of the respective signals makes it possible to provide a lower power consumption of the DC-PDP in comparison with the prior art scheme.

Figure 11:
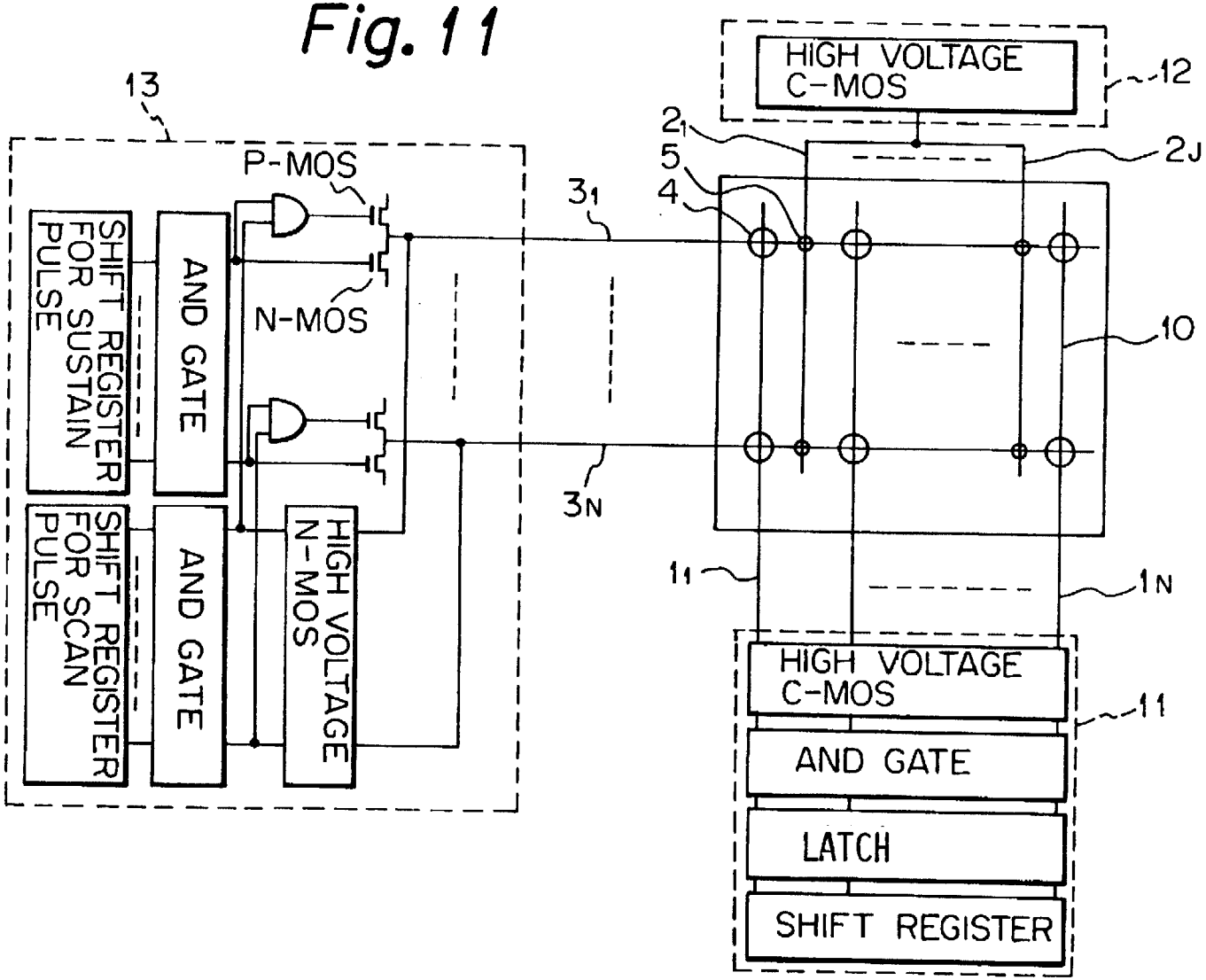
FIG. 11 is a schematic block diagram showing an embodiment of the DC-PDP and the drive circuit according to the present invention.

FIG. 11 is a schematic block diagram of the DC-PDP and its drive circuit implementing the memory drive scheme according to the present invention. The embodiment shown in FIG. 11 includes a display anode drive circuit 11 which comprises the anode drive circuits $11_1$–$11_N$ which are connected to the display discharge anodes $1_1$–$1_N$ of the DC-PDP 10, respectively. There is also provided a cathode drive circuit 13 comprising the cathode drive circuits $13_1$–$13_M$ which are connected to the cathodes $3_1$–$3_M$, respectively. Further, an auxiliary anode drive circuit 12 is connected to the auxiliary anodes $2_1$–$2_J$.

The display anode drive circuit 11 is constituted of, for example, a shift register, a latch circuit, an AND gate circuit and a high voltage C-MOS driver. The auxiliary anode drive circuit 12 is constituted of, for example, a high voltage C-MOS driver. With the embodiment, the cathode drive circuit 13 is constituted of a scan pulse generating unit which comprises a shift register for scan pulse, an AND gate circuit and a high voltage N-MOS driver, and a sustain pulse generating unit which comprises a shift register for sustain pulse, an AND gate circuit a high voltage P-MOS driver and a high voltage N-MOS driver.

FIGS. 12a–12d show waveforms useful for understanding the memory drive scheme of the DC-PDP according to an alternative embodiment of the present invention. According to the embodiment shown and described with reference to FIGS. 7 and 8, the display electrodes $1_1$–$1_N$ are used as the display discharge anodes to which the non-write pulse $P_{NW}$ is applied as information to be displayed, and the scan electrodes $3_1$–$3_M$ are used as the cathodes to which the scan pulse $P_{SCN}$ an the sustain pulse $P_{SUS}$ are applied to perform the memory drive of the DC-PDP. In contrast, according to the alternative embodiment, the display electrodes $1_1$–$1_N$ are used as the display discharge cathodes to which the non-write pulse which offers a high level for non-writing is applied, and the scan electrodes $3_1$–$3_M$ are used as the anodes to which the scan pulse $P_{SCN}$ and the sustain pulse $P_{SUS}$ are applied to perform the memory drive on the DC-PDP.

FIGS. 12a–12d show a display cathode signal $K_N$ which is supplied to the display discharge cathodes $1_1, 1_2, \ldots 1_N$ and anode signals $A_1, A_2, \ldots, A_M$ which are supplied to the anodes $3_1, 3_2, \ldots 3_M$, respectively.

According to the alternative embodiment, in an application where the bias potential $V_{BK}$ of the display discharge cathodes $1_1, 1_2, \ldots 1_N$ is zero volts, for example, the high level of potential $V_{SCNH}$ of the scan pulse $P_{SCN}$ having its pulse width of 1.5 μs applied to the anodes $3_1, 3_2, \ldots 3_M$ is set up to 305V. The sustain pulses $P_{SUS}$, which are supplied to the anodes $3_1, 3_2, \ldots 3_M$, have also the pulse width of 1.5 μs, the high level of potential $V_{SUS}$ of the sustain pulse $P_{SUS}$ is set up to 255V. During the period of time in which none of the scan pulse $P_{SCN}$ and the sustain pulse $P_{SUS}$ are supplied, the bias potential $V_{BA}$ 220V is applied to the anodes $3_1, 3_2, \ldots 3_M$. Applied to the display discharge cathodes $1_1, 1_2, \ldots 1_N$ is a non-write pulse $P_{NW}$ having its pulse width of 1.5 μs dependent upon the information to be displayed. The data signal Kn shown in FIG. 12*d* has its low level corresponding to a turn-on level with which the write discharge is initiated depending upon information to be displayed, and its high level corresponding to a turn-off level when information is not displayed. The low level of the potential of the data signal Kn is set up to the bias potential $V_{BK}$, i.e. zero volts, and the high level of the potential $V_{NWH}$ is set up to 85V.

Figures 12A, 12B, 12C, 12D:
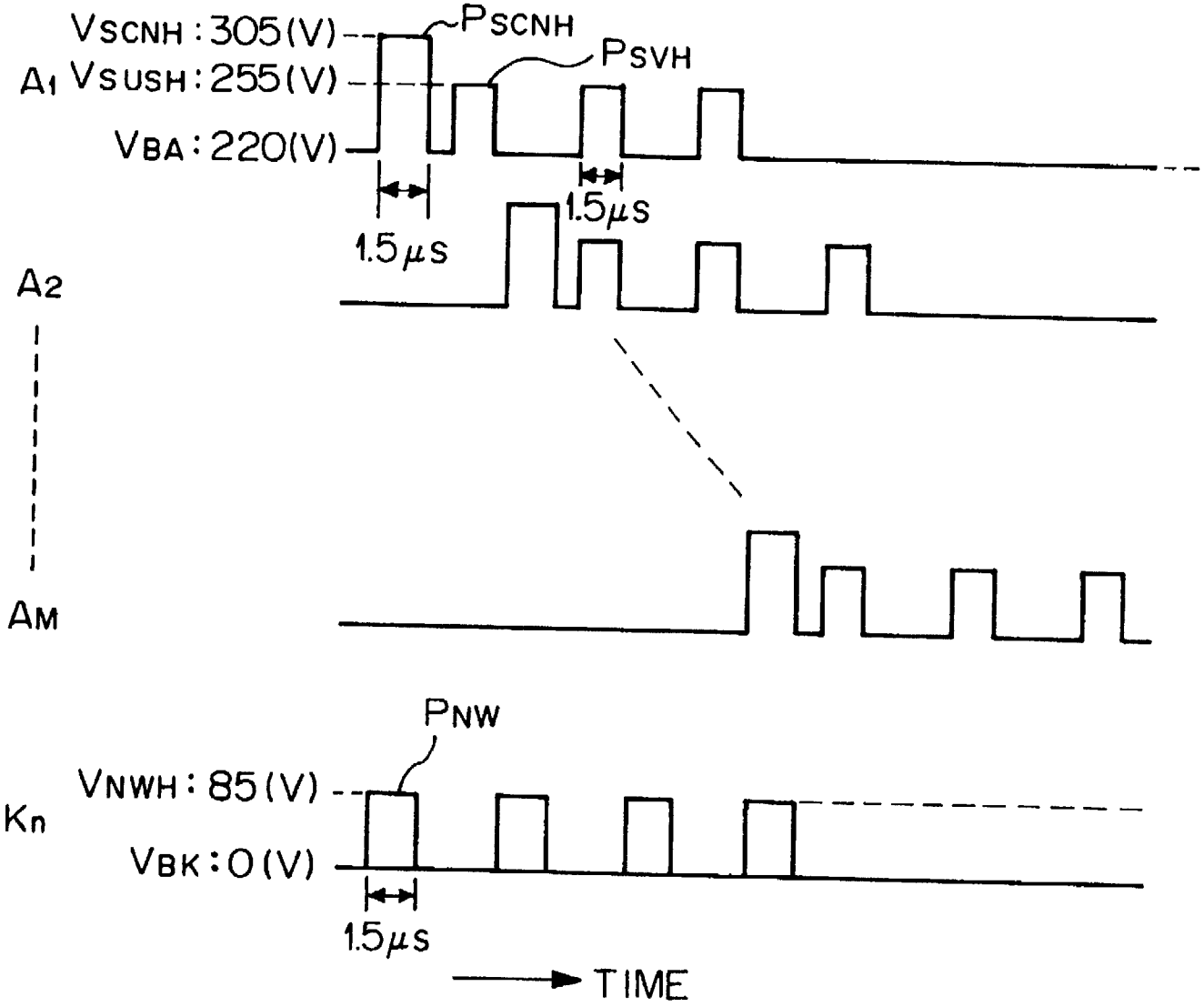
FIG. 12*a*–12*d* show waveforms useful for understanding how the memory of a DC-PDP is driven according to an alternative embodiment of the present invention.

In the DC-PDP in which the potential is set up as shown in FIGS. 12*a*–12*c*, for example, the scan pulses $P_{SCN}$ having a pulse width $\tau_{SCN}$ of 1.5 μs are supplied every 4 μs to the anodes $3_1, 3_2, \ldots 3_M$ serving as the scan electrodes. The supply of the scan pulses $P_{SCN}$ to the anodes $3_1, 3_2, \ldots 3_M$ is sequentially conducted with a time lag. Following the scan pulse $P_{SCN}$, the sustain pulses $P_{SUS}$ having the pulse width $\tau_{SCN}$, of 1.5 μs are applied to each of the anodes $3_1, 3_2, \ldots 3_M$ during a certain period of time at the timing not overlapping the scan pulse $P_{SCN}$. The bias voltage $V_{VBA}$ of the anodes $3_1, 3_2, \ldots 3_M$ is 220V during a period of time in which none of the of the scan pulse $P_{SCN}$ and the sustain pulse $P_{SUS}$ is applied thereto.

When the potential of the m-th row of anode $3_M$ is the high level of potential $V_{SCNH}$ 305V of the scan pulse $P_{SCN}$ through application of the scan pulse $P_{SCN}$, the voltage is 305V between the display discharge cathode $1_N$ and the anode $3_M$, so that the write discharge is initiated on the display cell 4*mn* in a fashion similar to that of the embodiment shown and described with reference to FIGS. 7 and 8. On the other hand, in an application where a write discharge is not conducted on the display cell 4*mn*, which means the case of non-writing, a non-write pulse $P_{NW}$ having its pulse width $\tau_{NW}$ of 1.5 μs is applied to the n-th column of display discharge cathode $1_N$ in synchronism with the scan pulse $P_{SCN}$ applied to the anode $3_M$. At that time, the voltage applied to the display cell 4*mn* is 220V, corresponding to $V_{SCNH}-V_{NWH}$, and does not reach the voltage which forms the discharge. Thus, a write discharge to the display cell 4*mn* is not formed.

If a write discharge is formed on the display cell 4*mn*, it can be maintained on the display cell 4*mn*, in spite of the voltage 255V, corresponding to $V_{SUSH}-V_{BK}$, lower than the write voltage 305V, at the timing of the sustain pulse PSUS which is supplied following the scan pulse $P_{SCN}$. Thus, the display cell 4*mn* sustains an intermittent discharge by the sustain pulse $P_{SUS}$, so that the memory drive is implemented. In the display cell in which the write discharge is not formed, there are a few ions and excited atoms. Thus, the sustain pulse $P_{SUS}$ applied following the scan pulse $P_{SCN}$ does not serve to form the discharge.

As described above, according to the alternative embodiment, the scan electrodes $3_1, 3_2, \ldots 3_M$ are used as the anodes to which the scan pulse $P_{SCN}$ and the sustain pulse $P_{SUS}$ are applied, and the display electrodes $1_1, 1_2, \ldots 1_N$ are used as the cathodes to which the non-write pulse $P_{NW}$ is applied. Hence, it is possible to set up the voltage for writing of the display cell 4*mn* separately from the voltage V13 for the sustain discharging.

The display anode signals applied to the display discharge cathodes $1_1$–$1_N$ are binary signals. The use of the binary signals make it possible to simplify the cathode drive circuits $11_1$–$11_N$ in structure. Further, according to the alternative embodiment, in a fashion similar to that of the earlier described embodiment, it is possible to obtain a sufficient memory margin for the respective display cells 4*mn*. In addition, the amplitudes of the anode signals $A_1, A_2, \ldots, A_N$ and the display cathode signals $K_1, K_2, \ldots, K_M$ are reduced, as 85V and 85V, respectively. This facilitates the anode drive circuit 13, the cathode drive circuit 11 and the like to be fabricated into an integrated circuit. Further, reducing the amplitude of the respective signals makes it possible to provide a lower power consumption of the DC-PDP in comparison with the prior art scheme.

The present invention is not restricted to the embodiments and various modifications can be available. The followings are set forth by way of example:

(1) The embodiments described above use the mixed gas of helium and xenon as the discharge gas. However, another type of gas may be used, such as the mixed gas of helium and neon or krypton, for example; and (2) The auxiliary discharge cell 5*mj* in both of the embodiments is used for the purpose of facilitating the write discharge for the display cell 4*mn*. However, the auxiliary discharge cell 5*mj* can be omitted, for example, in such an application in which a writing is performed through applying a higher voltage such as 1 kilovolt to the display cell 4*mn*.

As described above, according to the invention, the scan electrodes are fed with the train of scan pulses and sustain pulses with the display electrodes supplied with the non-write pulse, which offers the turn-off level only when information to be displayed and applied to the display cells is of non-display, and the write discharge commences for the display cells, to which information to be displayed is not of non-display, in response to the scan pulse and dependent upon the turn-on levels of the data signal, with the discharge sustained in response to the train of sustain pulses and dependent upon the turn-on level of the display electrode. Thus, it is possible to set up the writing voltage independently of the sustain voltage for the display cells in the PDP, thereby ensuring a sufficient memory margin. Further, according to the invention, it is possible to reduce the amplitude of the signals which are supplied to the display electrodes, the scan electrodes ad the auxiliary electrodes, thereby implementing a lower power consumption of the PDP, and in addition facilitating the peripheral circuits to be places in an integrated circuit.

According to the invention, the group of display electrodes and the group of scan electrodes are adopted as the group of anodes and the group of cathodes, respectively. The data signal is a binary signal having its high and low levels. The high level corresponds to a turn-on level with which the write discharge is initiated. The low level corresponds to a turn-off level for not-displaying. In a fashion similar to that of the earlier described embodiment, this feature makes it possible to ensure a sufficient memory margin and also to facilitate the PDP to consume lower power and the peripheral circuits to be placed in an integrated circuit. Further, it is possible to simplify in structure the anode drive circuit supplying non-write pulses.

According to the invention, the group of display electrodes and the group of scan electrodes may be adopted as the group of cathodes and the group of anodes, respectively. In that application, the data signal is a binary signal having its high and low levels. The low level corresponds to a turn-on level with which the write discharge is initiated. The high level corresponds to a turn-off level for not-displaying. In a fashion similar to that of the earlier described embodiment, this feature makes it possible to ensure a sufficient memory margin and also to facilitate the PDP to consume lower power and the peripheral circuits to be placed in an integrated circuit. Further, it is possible to simplify in structure the cathode drive circuit supplying non-write pulses.

While the present invention has been described with reference to the particular illustrative embodiments, it is not to be restricted by those embodiments. It is to be appreciated that those skilled in the art can change or modify the embodiments without departing from the scope and spirit of the present invention.

What is claimed is:

1. A method of memory driving a plasma display panel, which comprises a group of display electrodes constituted of a plurality of linear electrodes, a group of scan electrodes constituted of a plurality of linear electrodes arranged in such a manner that said group of scan electrodes is placed over against said group of display electrodes and is perpendicular to said group of display electrodes, a discharge gas being enclosed between said group of display electrodes and said group of scan electrodes, and a plurality of display cells disposed on intersections of the respective display electrodes and the respective scan electrodes, each of said plurality of display cells emitting light through a discharge between an associated display electrode and an associated scan electrode, said method comprising the steps of:

subsequently applying scan pulses to the scan electrodes, and applying a train of sustain pulses subsequent to the scan pulses to each of the scan electrodes during a certain period of time;

applying a non-write pulse to the display electrodes in synchronism with the scan pulses, the non-write pulse offering a turn-off level only when display information directed to the display cells is of a non-display; and initiating a write discharge for the display cells, when the display cells are brought into a display state, by means of applying the scan pulses to the scan electrodes, maintaining the display electrodes in the turn-on level, and sustaining the discharge in response to the train of sustain pulses applied to the scan electrode following the scan pulse and dependent on the turn-on level of the display electrode.

2. A method according to claim 1, wherein said group of display electrodes and said group of scan electrodes are adopted as a group of anodes and a group of cathodes, respectively, and said non-write pulse is applied in the form of a low level, which is the turn-off level of a data signal, in synchronism with the scan pulse only when a write discharge on the display cell is not conducted, and the turn-on level of the data signal is applied in the form of a high level for a display or a steady state.

3. A method according to claim 1, wherein said group of display electrodes and said group of scan electrodes are adopted as a group of cathodes and a group of anodes, respectively, and said non-write pulse is applied in the form of a high level, which is the turn-off level of a data signal, in synchronism with the scan pulse only when a write discharge on the display cell is not conducted, and the turn-on level of the data signal is applied in the form of a low level for a display or a steady state.

4. A method according to claim 1, wherein the scan pulse is different in amplitude from the train of sustain pulses.

* * * * *